US011162229B1

(12) United States Patent
Berry et al.

(10) Patent No.: US 11,162,229 B1
(45) Date of Patent: Nov. 2, 2021

(54) PAVER SYSTEM

(71) Applicants: Lisa Berry, Olathe, KS (US); Brett Berry, Olathe, KS (US)

(72) Inventors: Lisa Berry, Olathe, KS (US); Brett Berry, Olathe, KS (US)

(73) Assignee: Berry Outdoor, LLC, Shawnee, KS (US)

( * ) Notice: Subject to any disclaimer, the term of this patent is extended or adjusted under 35 U.S.C. 154(b) by 109 days.

(21) Appl. No.: 16/677,258

(22) Filed: Nov. 7, 2019

Related U.S. Application Data

(60) Provisional application No. 62/756,991, filed on Nov. 7, 2018.

(51) Int. Cl.
*E01C 5/00* (2006.01)
*E01C 5/06* (2006.01)

(52) U.S. Cl.
CPC ..... *E01C 5/06* (2013.01); *E01C 2201/06* (2013.01)

(58) Field of Classification Search
CPC ..... E01C 5/06; E01C 2201/06
USPC ..... 404/17–28, 34–36, 72–75
See application file for complete search history.

(56) References Cited

U.S. PATENT DOCUMENTS 572,762 A * 12/1896 Landers ..... B01D 2201/18 404/34
1,910,810 A * 5/1933 Nash ..... E04B 1/84 428/47
3,597,928 A * 8/1971 Pilaar ..... A01G 13/0268 405/20
4,376,595 A 3/1983 Shaw
4,715,743 A * 12/1987 Schmanski ..... A61H 3/066 404/9
4,860,510 A 8/1989 Kotler
5,342,142 A 8/1994 Barth et al.
(Continued)

FOREIGN PATENT DOCUMENTS

DE 9632538 A1 10/1996
DE 9850632 A1 11/1998
(Continued)

OTHER PUBLICATIONS

The Pavedrain System, Pave Drain Stormwater's Arch Enemy, www.pavedrain.com, 2018-08-17.
(Continued)

*Primary Examiner* — Raymond W Addie
(74) *Attorney, Agent, or Firm* — Erickson Kernell IP, LLC

(57) ABSTRACT

A paver system configured for installation on an existing hardscape. The paver system includes paving stones having a concave bottom surface. The concavity intersects edges of the paver to enable runoff to flow beneath and between the pavers. The concavity may also reduce the weight and material requirements of the paver while also increasing the strength of the paver. An underlayment is provided that includes a bottom surface with a plurality of intersecting channels. The underlayment is bonded to an existing hardscape, such as a concrete pad, and the pavers are arranged and bonded to the top surface of the underlayment. Rainwater and other runoff are allowed to flow between and under the pavers through the concave bottom portions thereof and through the channels in the underlayment. The paver system provides a strong, stable installation with sufficient drainage to resist damage caused by retained water.

12 Claims, 5 Drawing Sheets

(56) References Cited

U.S. PATENT DOCUMENTS

| | | | | |
|---|---|---|---|---|
| 5,400,561 | A * | 3/1995 | Metten | B28B 11/04 52/606 |
| 5,482,399 | A | 1/1996 | Bright et al. | |
| 5,823,706 | A | 10/1998 | Hoare et al. | |
| 6,379,079 | B1 | 4/2002 | Camomilla | |
| 6,939,077 | B1 | 9/2005 | Hart | |
| 7,244,076 | B2 * | 7/2007 | Whitson | E01C 1/00 404/34 |
| 7,404,689 | B1 * | 7/2008 | Poling | A47G 27/0468 404/31 |
| 7,594,365 | B2 * | 9/2009 | Kang | F24D 3/142 52/220.2 |
| D609,369 | S | 2/2010 | Buch | |
| 8,251,607 | B2 | 8/2012 | Buch | |
| 8,366,343 | B2 | 2/2013 | Buch | |
| 8,459,896 | B2 | 6/2013 | Buch | |
| 8,662,787 | B2 | 3/2014 | Sawyer et al. | |
| 8,747,018 | B2 * | 6/2014 | Smith | E01C 5/00 404/29 |
| 8,967,906 | B2 * | 3/2015 | Sawyer | E01C 5/18 404/28 |
| 9,938,670 | B2 | 4/2018 | White | |
| 2010/0205899 | A1 | 8/2010 | Califano | |
| 2013/0149034 | A1 | 6/2013 | Merriam | |
| 2014/0037377 | A1 * | 2/2014 | Lee | E01C 5/22 404/82 |
| 2014/0169878 | A1 | 6/2014 | MacDonald et al. | |

FOREIGN PATENT DOCUMENTS

| | | | |
|---|---|---|---|
| DE | 0019036 | A1 | 4/2000 |
| GB | 9715725 | A1 | 5/1997 |
| GB | 2017060715 | A2 | 4/2017 |
| IT | 2009053185 | A2 | 4/2009 |
| IT | 2012107942 | A1 | 8/2012 |
| KR | 2010120022 | A1 | 10/2010 |
| KR | 2017039104 | A1 | 3/2017 |
| NO | 2009075587 | A1 | 6/2009 |
| WO | 2017083977 | A1 | 5/2017 |
| WO | 2017190230 | A1 | 11/2017 |

OTHER PUBLICATIONS

Pavedrain LLC, Pave Drain Stormwater's Arch Enemy, Brochure, 2017,1-4, Milwaukee.

* cited by examiner

PAVER SYSTEM

CROSS-REFERENCE TO RELATED APPLICATIONS

This application claims the benefit of U.S. Provisional Patent Application No. 62/756,991 filed Nov. 7, 2018, the disclosure of which is hereby incorporated herein in its entirety by reference.

BACKGROUND

The use of bricks, stones, concrete blocks, tiles, and the like as a pavement or hardscape has been done for centuries. Typically, such installations employ one or more base layers formed from a variety of particulate materials like sand and gravel that are laid down and compacted to provide both support for the pavement members as well as drainage of water away from the installation. These installations suffer from a variety of problems that can degrade the installation including erosion of the support base, undermining of the support base by animal activity, and ground movement caused by freeze/thaw conditions, among others.

Some installations are made over existing hardscapes, such as concrete which provides sufficient support for the pavement members and eliminates some of negative issues associated with the particulate-base installations described above. But these installations suffer from inadequate drainage. In such installations, water may collect and pool between the pavement members and/or between the pavement members and the underlying hardscape. This can lead to breakdown of the pavement members, growth of mold and other organics around and on the pavement members, and overall physical and aesthetic degradation of the installation.

SUMMARY

Exemplary embodiments are defined by the claims below, not this summary. A high-level overview of various aspects thereof is provided here to introduce a selection of concepts that are further described in the Detailed-Description section below. This summary is not intended to identify key features or essential features of the claimed subject matter, nor is it intended to be used in isolation to determine the scope of the claimed subject matter. In brief, this disclosure describes a paver system configured for installation on an existing hardscape and methods for such installation.

The paver system includes a plurality of prefabricated pavers and an underlayment. In one embodiment, the pavers comprise molded concrete tiles with a generally square perimeter and that include a partially concave bottom surface. A central portion of the bottom surface is arched or domed to be recessed into the body of the paver in a generally uniform manner to provide a generally circular concavity that intersects the perimeter of the paver along each side edge thereof. Corners of the bottom surface lie outside the concavity and thus form generally planar feet on which the paver rests when placed on a surface. The concavity of the central portion reduces the amount of material required to produce the paver as well as the weight thereof. The intersection of the concavity with the perimeter of the paver along edges thereof provides a passageway through which water can pass beneath and between the pavers.

The underlayment comprises a sheet of material having differing top and bottom surfaces. The top surface is flat to provide a continuous support surface on which the pavers can be disposed. The bottom surface includes a recessed grid pattern of spaced apart longitudinal and transverse channels or recesses with a plurality of support pads formed therebetween. The support pads support the underlayment on a hardscape or other surface while the recesses allow water to flow between the underlayment and the hardscape. The underlayment may also include a plurality of drainage openings extending through the thickness of the underlayment to enable passage of water vertically through the underlayment.

In use the underlayment is coupled to the hardscape, preferably through the use of an adhesive, glue, cement, or other bonding agent and/or one or more fasteners. The same or different adhesive is also applied to the feet of the pavers which are laid on the underlayment in a desired pattern. The pavers may also be coupled to one another using the chosen adhesive.

DESCRIPTION OF THE DRAWINGS

Illustrative embodiments are described in detail below with reference to the attached drawing figures, and wherein.

DETAILED DESCRIPTION

Figure 1:
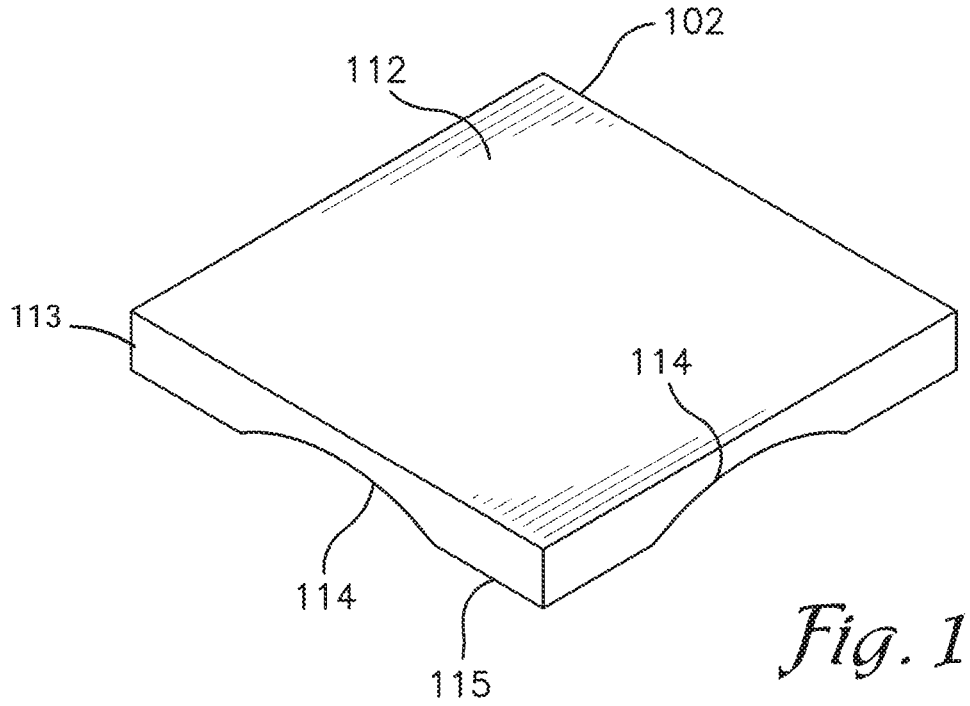
FIG. 1 is a perspective top view of a paver depicted in accordance with an exemplary embodiment.

The subject matter of select exemplary embodiments is described with specificity herein to meet statutory requirements. But the description itself is not intended to necessarily limit the scope of claims. Rather, the claimed subject matter might be embodied in other ways to include different components, steps, or combinations thereof similar to the ones described in this document, in conjunction with other present or future technologies. Terms should not be interpreted as implying any particular order among or between various steps herein disclosed unless and except when the order of individual steps is explicitly described. The terms "about" or "approximately" or "substantially" as used herein denote deviations from the exact value by +/−10%, preferably by +/−5% and/or deviations in the form of changes that are insignificant to the function.

With reference now to FIGS. 1-6, a paver system 100 is described in accordance with an exemplary embodiment. The paver system 100 includes a plurality of paving stones or pavers 102 and an underlayment 104 that are installed on an existing hardscape 106. The terms "paving stones" and "paver" are used herein in reference to the pavers 102 but is not intended to limit the pavers 102 to any particular type or form of building material used for paving, hardscaping, flooring, or the like. For example, the terms "paving stone" and "paver" are often used by those of skill in the art to refer to a manufactured or cast concrete or composite block or tile that may have a variety of shapes, colors, surface textures, and other characteristics. The pavers 102 may comprise such "paving stones" or "pavers" but other materials such as bricks, natural stones, porcelain tiles, ceramic tiles, or the like may also be employed.

In one embodiment, the pavers 102 comprise a cast concrete or composite tile having a generally cuboidal form with a square perimeter and a thickness with a dimension substantially less than the length and width dimensions. For example, the paver 102 may have a length and width of about 9.0 inches and a thickness of about 1.25 inches, however other dimensions are foreseeable. Although the paver 102 is described herein as having a generally square shape, other shapes may be employed without departing from the scope of embodiments described herein.

The paver 102 includes a bottom surface 108 with a recessed dome or concave portion 110. The concave portion 110 has a generally uniform shape resembling or mimicking the intersection of a sphere or spheroid with the bottom surface 108 of the paver 102. In other embodiments, the concave portion 110 may incorporate one or more other uniform or non-uniform forms. The concave portion 110 reduces an amount of material required to form the paver 102 and thus the weight of the paver 102. The domed form of the concave portion 110 may also increase the strength of the paver 102 with respect to forces applied on a top surface 112 thereof such as by foot or vehicle traffic in a manner similar to that of an arch or dome structure. In some embodiments, including those in which a non-square shaped paver 102 is employed, more than one intersecting concave portion 110 may be incorporated into the bottom surface 108.

The perimeter of the concave portion 110 intersects the perimeter of the paver 102 along each edge of the bottom surface 108 to form openings 114 or entrances from outside the perimeter through sidewalls 113 thereof and into the concave portion 110 beneath the paver 102. The openings 114 are generally centrally located along each sidewall 113 of the paver 102 and have an arched or arcuate form created by the intersection of the spherical concave portion 110 with the linear sidewall 113 of the paver 102. It is however understood that the openings 114 may be otherwise positioned and shaped without departing from the scope of embodiments described herein. The openings 114 and the concave portion 110 thus provide a passageway extending both longitudinally and transversely beneath the paver 102. Where more than one concave portion 110 is provided in the paver 102, the concave portions 110 preferably intersect to provide openings therebetween.

Figure 2:
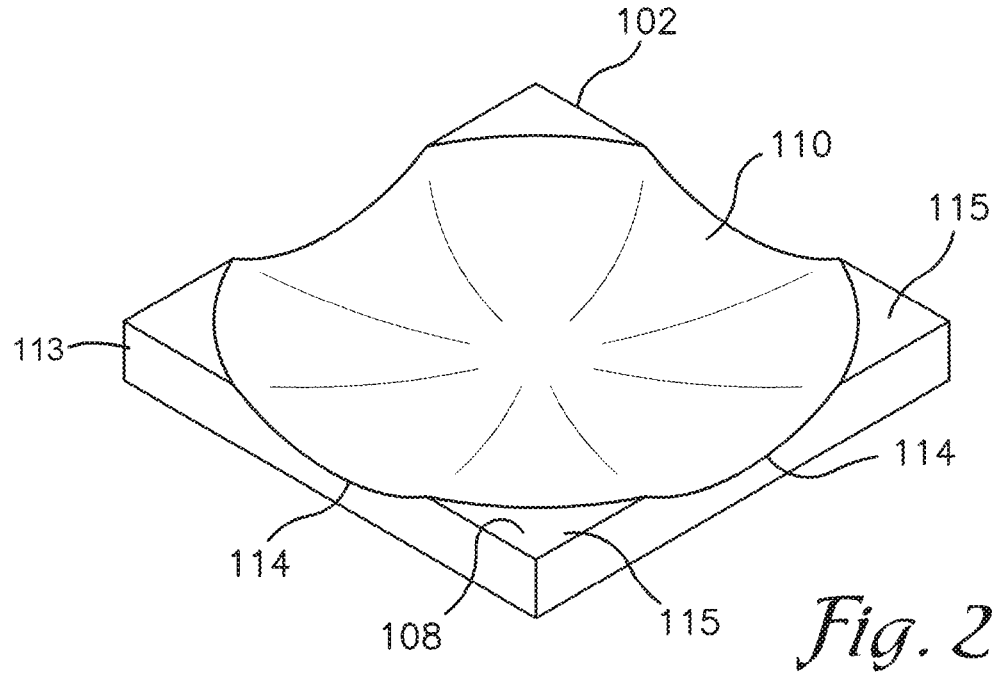
FIG. 2 is a perspective bottom view of the paver of FIG. 1.

Sections of the bottom surface 108 of the paver 102 that lie outside the concave portion 110 form feet 115 on which the paver 102 rests when placed on a surface. As depicted in FIG. 2, the feet 115 are formed at corners of the paver 102, however the feet 115 may be formed at other locations along the bottom surface 108.

Figure 3:
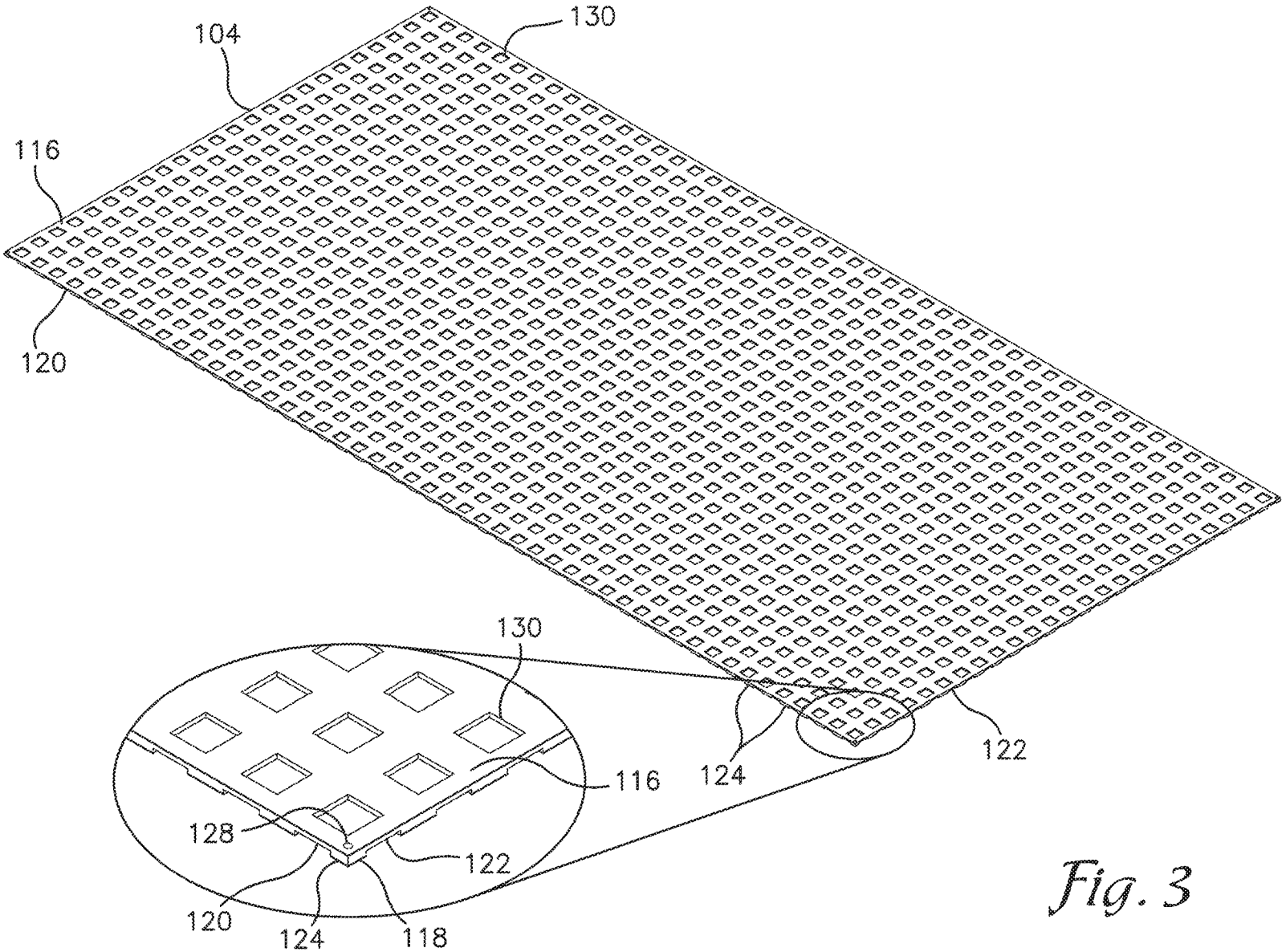
FIG. 3 is a top perspective view with an enlarged pop-out view of an underlayment depicted in accordance with an exemplary embodiment.

With reference now to FIG. 3, the underlayment 104 comprises a thin sheet of a rigid or semi-rigid material. In one embodiment, the underlayment 104 is comprised of a polyvinyl chloride (PVC) sheet that is provided in approximately 4-foot by 8-foot sheets that are about 0.5 inches to about 1.5 inches thick. In another embodiment, the underlayment 104 is provided in a semi-rigid form that can be rolled onto itself and stored in rolls of any desired length.

A topside surface 116 of the underlayment is generally flat and may be provided with a desired roughness configured to aid bonding with an adhesive, glue, cement, bonding agent, or the like (hereinafter referred to generally as an adhesive 126) as described below. In one embodiment, the adhesive 126 comprises a polyurethane cement.

A bottom-side surface 118 of the underlayment 104 includes a series of spaced apart longitudinal recesses or channels 120 and transverse recesses or channels 122 arranged in a grid-like pattern. A plurality of pads 124 are formed between the longitudinal and transverse channels 120, 122 which support the underlayment 104 when laid on a hardscape surface. The pads 124 may be provided with a surface texture or features to aid bonding of the pads 124 with the hardscape 106 using the adhesive 126. In another embodiment, the pads 124 and/or the underlayment 104 generally may provide apertures 128 or other features that are molded in or formed thereon to accommodate installation of fasteners through the underlayment 104 and into an underlying substrate. Such fasteners may be employed in addition to or instead of the adhesive 126 between the pads 124 and the surface of the underlying substrate.

Through-holes 130 may be provided through the topside surface 116 and the thickness of the underlayment 104 that enable passage of liquids vertically through the underlayment 104 and into the longitudinal and transverse channels 120, 122. The through-holes 130 may comprise apertures aligned with intersections of the channels 120, 122, as depicted in FIG. 3, or may take a variety of other forms. In one embodiment, the topside surface 116 of the underlayment 104 is porous; the through-holes 130 may thus comprise pores or interconnected passageways through the topside surface 116 of the underlayment 104 that enable passage or infiltration of liquids therethrough.

Although, the channels 120 and 122 are described herein as being arranged in a grid-like pattern at right angles to one another, other arrangements of the channels 120, 122 that provide sufficient drainage and support for the installation may be employed without departing from the scope of embodiments described herein. For example, the channels 120, 122 might be arranged at acute angles to one another to form diamond-shaped pads 124 or the channels 120, 122 might be arranged to provide pads 124 having another polygonal shape, such as a hexagon, octagon, or the like. The channels 120, 122 might also be provided in a non-linear form, such as a wave.

Figure 4:
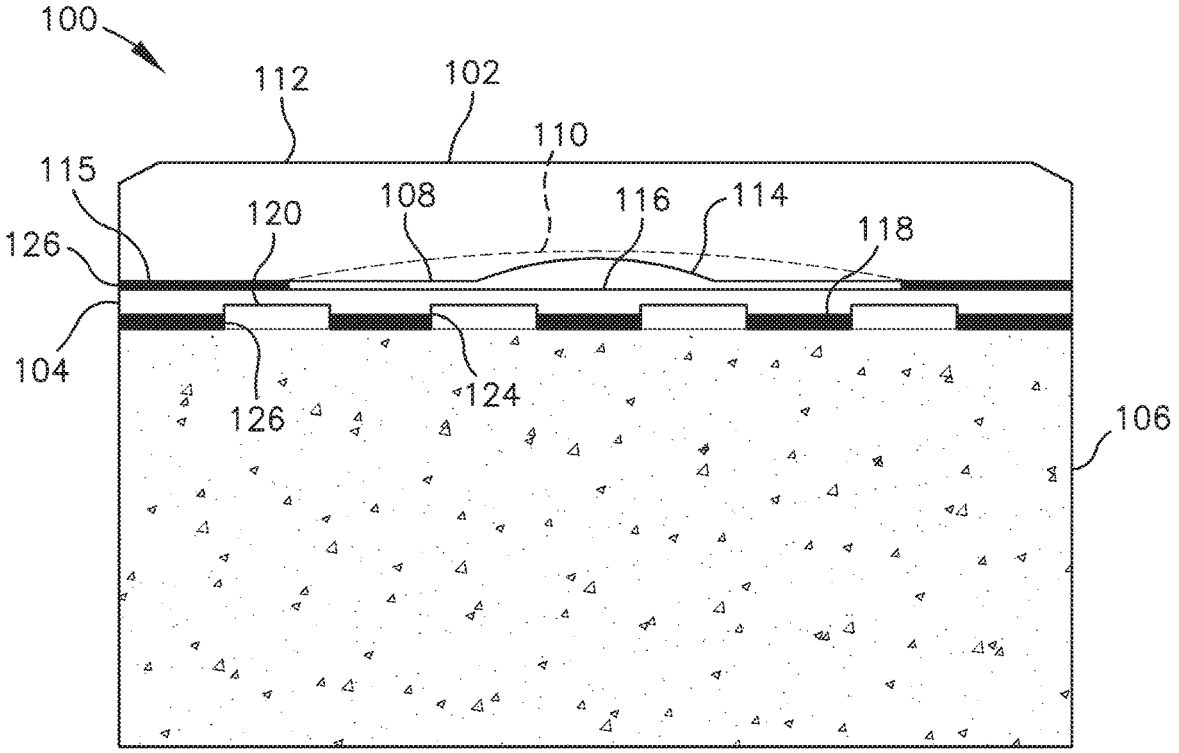
FIG. 4 is a side elevational view of the paver of FIG. 1 and the underlayment of FIG. 3 installed on a hardscape in accordance with an exemplary embodiment.
Figure 5:
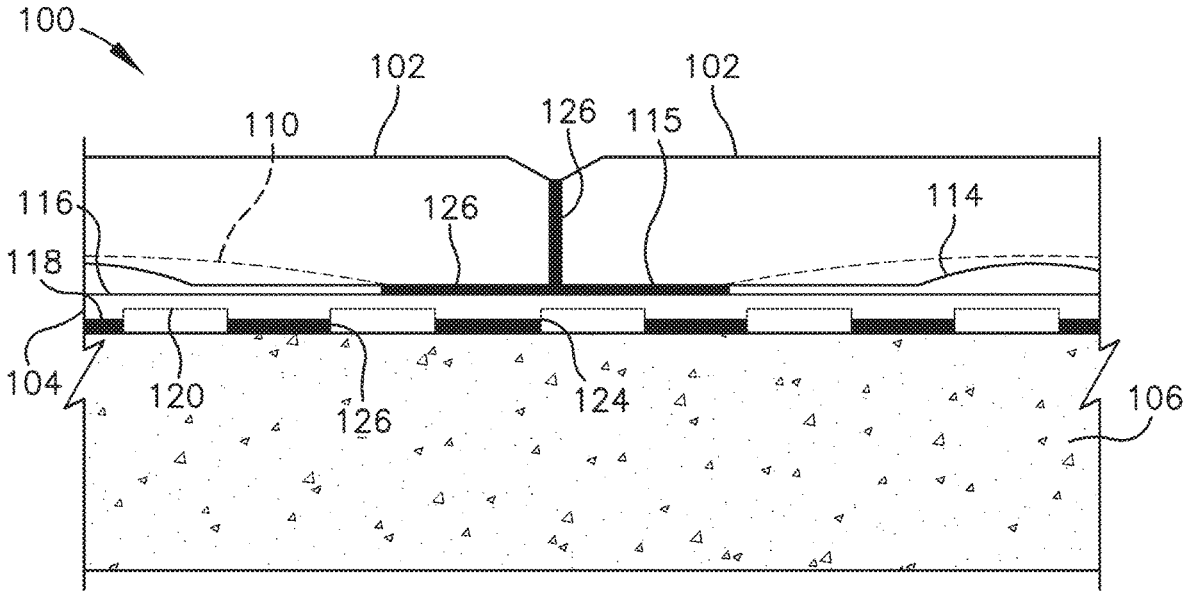
FIG. 5 is a side elevational view of a pair the pavers of FIG. 1 installed side-by-side on a hardscape in accordance with an exemplary embodiment.
Figure 6:
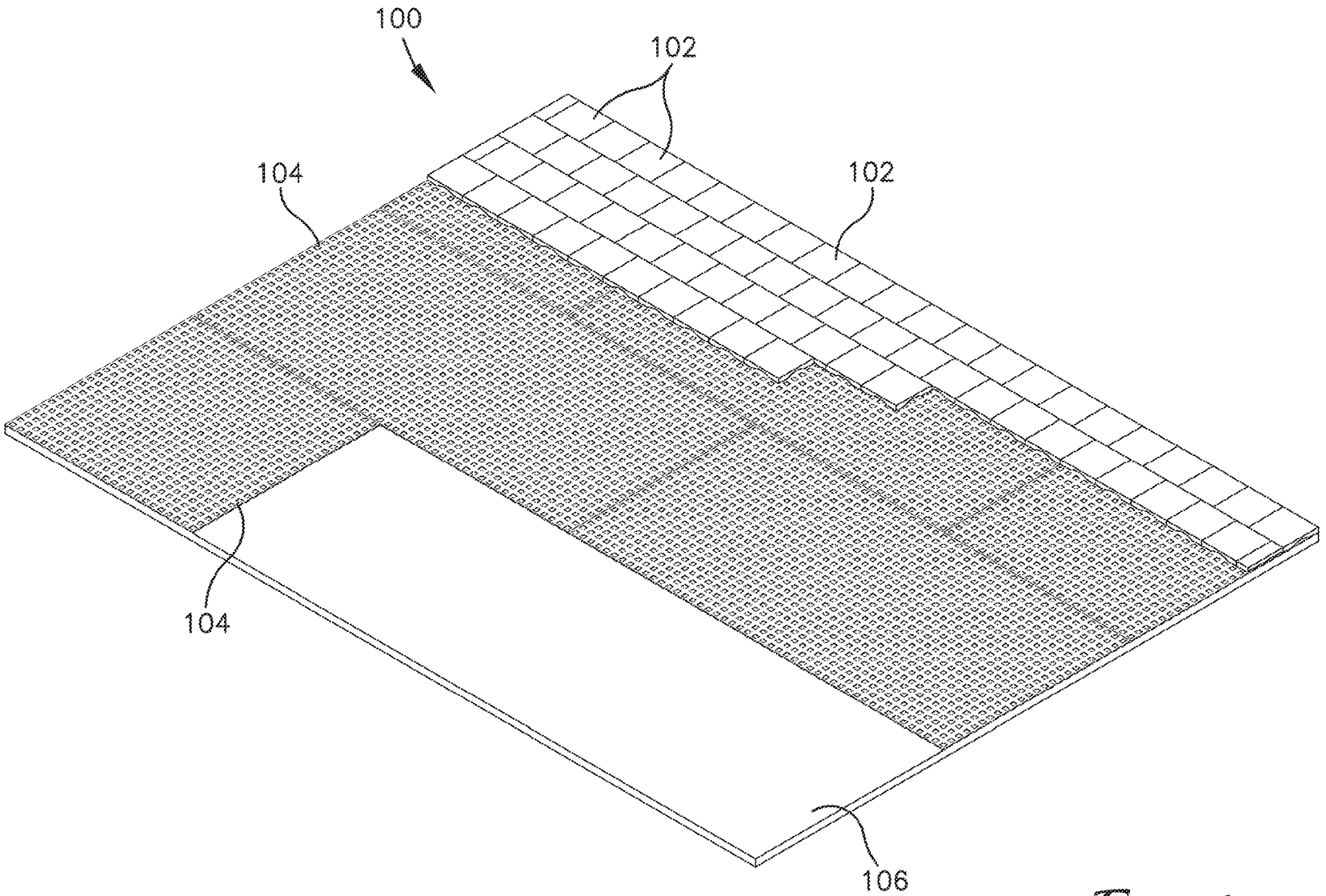
FIG. 6 is a perspective view of an installation of pavers on a hardscape in accordance with an exemplary embodiment.

With continued reference to FIGS. 4-6, installation of the paver system 100 is described in accordance with an exemplary embodiment. The paver system 100 is configured for installation on an existing hardscape 106. The hardscape 106 may comprise a concrete structure such as a patio, driveway, sidewalk, or the like. Such hardscapes 106 often have various surface and/or structural deformities like cracks, expansion gaps, chips, texturing, and the like that affect the uniformity and evenness of the surface. Depending on the severity of such deformities, an installer may take initial steps to remedy any structural issues and/or flatten any major deformities. For example, where the hardscape 106 includes large depressions where pieces of the hardscape 106 have been broken away, such depressions might be filled in. However, such remedial measures are not typically required prior to installation of the paver system 100. As such, equipment needs for preparing the installation site are greatly reduced over that of known methods which require removal of the existing hardscape 106 and construction of a new particulate material base. This also greatly reduces the deleterious effects of such activities on the surrounding areas.

In some embodiments, a user might wish a final installation to have larger dimensions than the existing hardscape 106. In such embodiments, the hardscape 106 may be expanded by known methods to add additional sections of, for example, concrete to the existing hardscape 106. In one embodiment, the paver system 100 may be extended beyond a perimeter of the existing hardscape 106 and onto a particulate subbase that is installed by means known in the art.

In one embodiment, the bottom surface 118 of the underlayment 104 has sufficient resilience and/or flexibility to conform to deformities in the surface of the hardscape 106 and to mask the deformities. As such, the topside surface 116 of the underlayment 104 may remain substantially uniform and flat when the underlayment 104 is placed on a hardscape 106 that includes such deformities.

As depicted in FIG. 6, one or more sheets of the underlayment 104 are fitted to the hardscape 106 to cover the top surface thereof. The underlayment sheets 104 may be arranged and cut or trimmed as necessary to fit the hardscape 106. Cutting of the underlayment 104 may be completed using conventional hand tools and/or power tools such as clippers, nippers, saws, or the like. The sheets of the underlayment 104 are arranged to abut one another along their edges without overlapping. In one embodiment, edges of the sheets of underlayment 104 may partially overlap. The abutting edges of the sheets of the underlayment 104 may be coupled together using one or more fasteners, tapes, or the like, or by welding or applying a layer of the adhesive 126.

The adhesive 126 is applied to the surface of the hardscape 106. In another embodiment, the adhesive 126 is applied to the underlayment 104. The adhesive 126 may be applied by any conventional manner including spraying, applying by brush or roller, and/or dispensing from a container such as a tube or cartridge using a caulking gun or similar means. The adhesive 126 may be applied to the entire hardscape 106 surface or only along desired portions thereof, e.g. along areas that align with edges of the underlayment 104 or areas that align with the pads 124 of the underlayment 104. The adhesive 126 may be applied directly to all or selected ones of the pads 124 of the underlayment 104 using similar methods.

Following application of the adhesive 126 to the hardscape 106 and/or the underlayment 104, the underlayment 104 is disposed on the hardscape 106 in a desired arrangement. Downward pressure may be applied to the underlayment 104 to provide sufficient contact between the underlayment 104, the adhesive 126, and the hardscape 106 to enable the adhesive 126 to form a sufficient bond. The pressure may be applied manually by hand or by otherwise pressing downward on the underlayment 104 or other manual or automated tools may be employed. For example, a weighted roller may be moved over the underlayment 104 to provide downward pressure thereon or an automated, vibrating, tamping, or compacting machine may be used in a conventional manner.

The adhesive 126, such as a polyurethane cement, bonds or affixes the pads 124 of the underlayment 104 with the hardscape 106 to substantially resist movement of the underlayment 104 relative to the hardscape 106. In one embodiment, one or more fasteners, such as screws, nails, or the like are driven through the underlayment 104, such as through the apertures 128, and into the hardscape 106 to anchor the underlayment 104 to the hardscape 106. Such fasteners may be employed in addition to or instead of the adhesive 126.

A plurality of the pavers 102 are arranged side-by-side on the top surface 116 of the underlayment 104 in a desired arrangement. The concave portion 110 of the pavers 102 reduces the weight of the pavers 102 and thus eases installation activities as well as tasks associated with transportation of pavers 102 to the installation site. The underlayment 104 provides a substantially even and continuous surface on which the pavers 102 are laid, which results in a substantially even surface being formed by the pavers 102. Deformities in the hardscape 106 surface are masked and hidden by the underlayment 104 and thus are not visible in the final surface created by the pavers 102.

The adhesive 126 is applied to the topside surface 116 of the underlayment 104 and/or to the feet 115 of the pavers 102 to bond the pavers 102 to the underlayment 104. As depicted in FIG. 5, the adhesive 126 may also be applied along all or a portion of the side faces of the pavers 102 to bond the pavers 102 together. The adhesive 126 applied between the pavers 102 may be the same or different than that applied between the pavers 102 and the underlayment 104. In one embodiment, the adhesive 126 applied between the pavers 102 also acts as a filler between the pavers 102 which may provide a desired aesthetic appearance as well as aid to prevent water infiltration between the pavers 102. In another embodiment, a polymeric sand or similar material known in the art may be disposed between the pavers 102 by means known in the art. Such materials may be water permeable to allow water to pass vertically downward between adjacent pavers 102.

The bonding of the underlayment 104 with the hardscape 106 and with the pavers 102 provides a strong and durable installation that resists vertical and horizontal movement of the pavers 102. Additional bonding of the pavers 102 to one another provides additional strength, rigidity, and stability to the installation.

Following installation, the paver system 100 provides additional drainage of rainwater over that found in known installations. This reduces incidence of mold, algae, and other organic growth on the pavers 102 as well as degradation of the pavers 102 and of the installation generally that may be caused by standing or retained water in contact with the components of the installation.

Rainwater and other fluid runoff that is encountered by the installation may be handled by one or more means. The rainwater may be at least partially shed along the top surfaces 112 of the pavers 102 to an edge of the installation where it is passed to the surrounding environment. The rainwater may also infiltrate between the pavers 102 where it contacts the topside surface 116 of the underlayment 104 and flows between and under the pavers 102. Flow passageways under the pavers 102 are provided by the concave portions 110 and the openings 114 thereto. The rainwater can thus pass through the opening 114 in the sidewall 113 of a paver 102, into the concave portion 110, and then out of another opening 114 along another sidewall 113 of the paver 102 before continuing to flow beneath an adjacent paver 102 in a similar manner. As such, the rainwater is not trapped between the pavers 102 and is allowed to flow along and out of the installation. In one embodiment, one or more through holes 130 are provided through the thickness of the underlayment 104 that enable the rainwater to flow vertically through the underlayment 104 and into the channels 120, 122. Once in the channels 120, 122, the rainwater can flow along the hardscape 106 and away from the installation. Additionally, rainwater may infiltrate into the channels 120, 122 along edges of the sheets of the underlayment 104 and be similarly allowed to flow along the channels 120, 122 out of and away from the installation.

Figure 7:
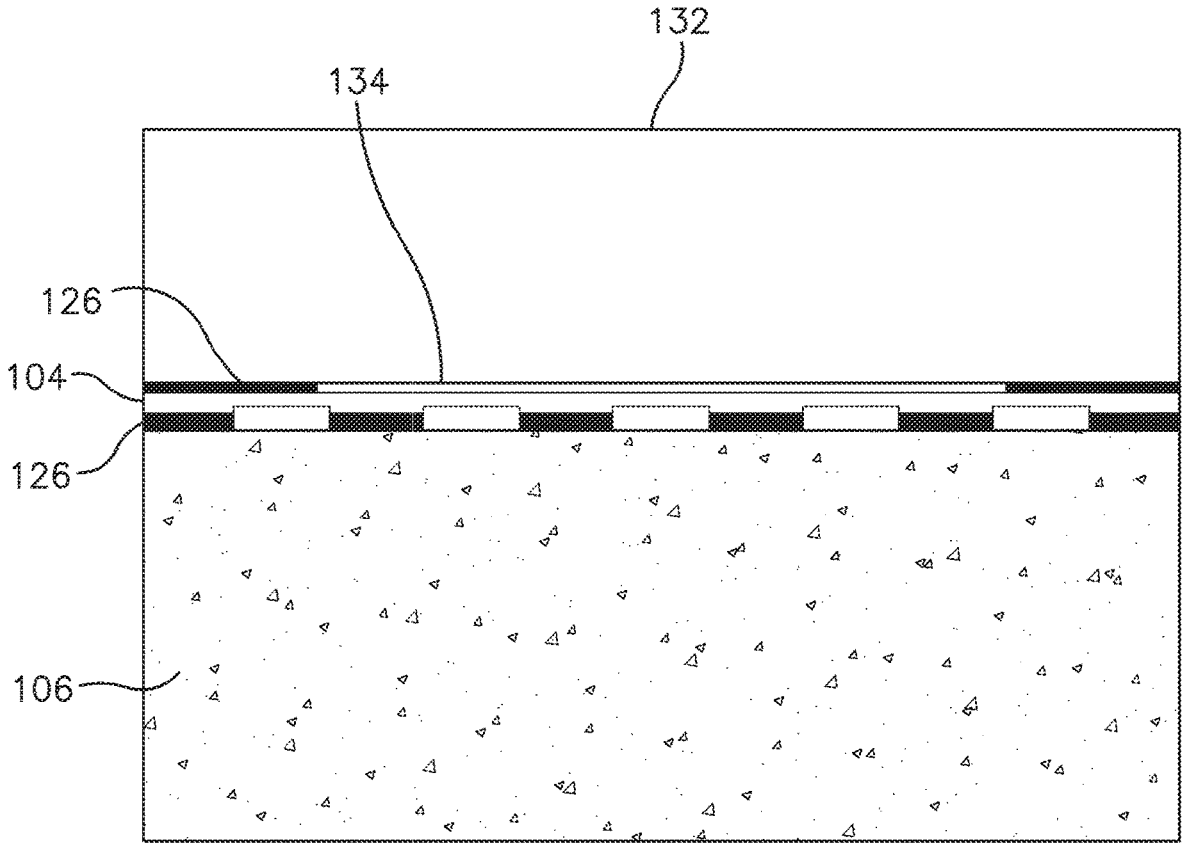
FIG. 7 is a side elevational view of a known paver component installed using the underlayment of FIG. 3 in accordance with an exemplary embodiment.

In another embodiment depicted in FIG. 7, an alternative paving block 132 is employed in place of or in addition to the pavers 102. The block 132 may comprise an existing, conventional paving component, such as a brick, stone, ceramic tile, or the like and does not include the concave portion 110. The blocks 132 may be laid on the underlayment 104 in a manner similar to that used for the pavers 102. In such an installation, drainage may be provided by vertical flow of fluid between the blocks 132 and into the channels 120, 122 of the underlayment 104.

Additional drainage may also be provided between the blocks 132 and the topside surface 116 of the underlayment 104 by selectively applying the adhesive 126 to a bottom surface of the blocks 132 in a manner that does not completely enclose the bottom perimeter thereof. For example, the adhesive might be applied only at corners of the bottom surface of the blocks 132. A thickness of the adhesive 126 may provide a slight gap 134 between the bottom surface of the blocks 132 and the top surface 116 of the underlayment 104 such that fluid may flow at least partially therebetween.

Many different arrangements of the various components depicted, as well as components not shown, are possible without departing from the scope of the claims below. Embodiments of the technology have been described with the intent to be illustrative rather than restrictive. Alternative embodiments will become apparent to readers of this disclosure after and because of reading it. Alternative means of implementing the aforementioned can be completed without departing from the scope of the claims below. Identification of structures as being configured to perform a particular function in this disclosure and in the claims below is intended to be inclusive of structures and arrangements or designs thereof that are within the scope of this disclosure and readily identifiable by one of skill in the art and that can perform the particular function in a similar way. Certain features and sub-combinations are of utility and may be employed without reference to other features and sub-combinations and are contemplated within the scope of the claims.

What is claimed is:

1. A system for applying paving stones over a hardscape, the system comprising:

a plurality of cuboidal paving stones, each of the paving stones including a top surface, a bottom surface, and a plurality of sidewalls extending between the top surface and the bottom surface, the bottom surface having a concave portion that is recessed into the bottom surface and toward the top surface wherein the concave portion mimics an intersection of a spheroid with the bottom surface, the concave portion intersecting one or more of the sidewalls to form an opening in each of the one or more sidewalls, the openings and the concave portion forming a fluid passageway beneath the paving stone, the bottom surface including a plurality of feet formed between the concave portion and respective ones of the sidewalls; and an adhesive that is disposable on one or more of the feet and configured to resist movement of the plurality of paving stones relative to a hardscape.

2. The system of claim 1, wherein the paving stone includes four sidewalls that are each intersected by the concave portion, and wherein the opening in each of the sidewalls is centrally located along a length thereof and includes an arcuate form.

3. The system of claim 1, wherein the hardscape comprises a concrete pad.

4. The system of claim 1, further comprising:

a planar underlayment sheet that includes a substantially flat topside surface and a plurality of channels formed in a bottom-side surface, the bottom-side surface of the underlayment sheet being disposed on the hardscape and the plurality of paving stones being disposed on the topside surface of the underlayment sheet, the channels forming fluid passageways between the underlayment sheet and the hardscape.

5. The system of claim 4, wherein the adhesive is disposed between the topside surface of the underlayment sheet and the one or more feet of the paving stones.

6. The system of claim 4, wherein the underlayment sheet includes a plurality of pads on the bottom-side surface configured to support the underlayment sheet on the hardscape, and wherein the adhesive is disposed between one or more of the pads and the hardscape.

7. The system of claim 4, wherein the underlayment sheet includes a plurality of through-holes extending through a thickness of the underlayment sheet between the topside surface and the bottom-side surface, the through-holes being configured to enable fluid flow through the underlayment sheet and into the channels.

8. The system of claim 4, wherein the plurality of channels comprises a plurality of intersecting channels.

9. The system of claim 8, wherein the plurality of channels comprises a plurality of longitudinal channels and a plurality of transverse channels that intersect in a grid pattern.

10. The system of claim 4, wherein the underlayment sheet is substantially rigid.

11. The system of claim 4, wherein the underlayment sheet is formed from a polyvinyl chloride (PVC) material.

12. A paving stone installation on a hardscape, the installation comprising:

a concrete hardscape pad having a substantially planar top face;

an underlayment sheet disposed on the hardscape, the underlayment sheet including a substantially flat topside surface and a plurality of channels formed in a bottom-side surface, the channels forming fluid passageways between the underlayment sheet and the hardscape pad;

a plurality of cuboidal paving stones disposed on the topside surface of the underlayment sheet, each of the paving stones including a top surface, a bottom surface, and a plurality of sidewalls extending between the top surface and the bottom surface, the bottom surface having a concave portion that is recessed into the bottom surface wherein the concave portion mimics an intersection of a spheroid with the bottom surface, the concave portion intersecting each of the sidewalls to form an arcuate opening in each of the sidewalls wherein each opening is centrally located along a length of the sidewall it is formed in, the openings and the concave portion forming a fluid passageway beneath the paving stone, the bottom surface including a plurality of feet formed between the concave portion and respective ones of the sidewalls;

a first adhesive disposed between one or more of the feet of one or more of the plurality of paving stones and affixing the one or more of the plurality of paving stones to the underlayment sheet; and a second adhesive disposed between at least a portion of the underlayment sheet and the hardscape pad and affixing the underlayment sheet to the hardscape pad, the second adhesive being the same or different than the first adhesive.

* * * * *